United States Patent [19]

Lonati

[11] Patent Number: 4,712,390

[45] Date of Patent: Dec. 15, 1987

[54] CIRCULAR KNITTING MACHINE INCORPORATING A STITCH DENSITY ADJUSTER DEVICE

[75] Inventor: Francesco Lonati, Brescia, Italy

[73] Assignee: Lonati SpA, Brescia, Italy

[21] Appl. No.: 805,009

[22] Filed: Dec. 5, 1985

[30] Foreign Application Priority Data

Dec. 10, 1984 [IT] Italy ..... 23969 A/84

[51] Int. Cl.[4] ..... D04B 15/32

[52] U.S. Cl. ..... 66/54

[58] Field of Search ..... 66/27, 54, 71, 77

[56] References Cited

U.S. PATENT DOCUMENTS 4,231,234 11/1980 Schmid et al. ..... 66/27

4,526,017 7/1985 Shima ..... 66/71

4,554,802 11/1985 Goller et al. ..... 66/71

FOREIGN PATENT DOCUMENTS 491948 3/1954 Italy ..... 66/71

*Primary Examiner*—Wm. Carter Reynolds

*Attorney, Agent, or Firm*—Guido Modiano; Albert Josif

[57] ABSTRACT

The device has a slide rigidly associated with a stitch cam and being movable relatively to the cam assemblies of the needle cylinder in a substantially parallel direction to the needle cylinder aixs. The device is peculiar in that it has a step motor controlled by an electronic machine control and connected to a drive cam which engages rotatably with said slide to impart to the stitch cam a set displacement relatively to the needle cylinder cam assemblies; the slide is also movable relatively to said cam assemblies against and by the action a spring.

5 Claims, 7 Drawing Figures

CIRCULAR KNITTING MACHINE INCORPORATING A STITCH DENSITY ADJUSTER DEVICE

BACKGROUND OF THE INVENTION

This invention relates to a circular knitting machine incorporating a stitch density adjuster device, and in particular, to a circular hose-knitting machine.

As is known this adjustment is performed by shifting the needle cylinder vertically with respect to the stitch formation plane, and hence, to the cam assemblies, to obtain longer or shorter stitches. The cylinder, which is displaceable axially to the cylinder holder, bears by means of bearing rods on a thrust bearing, in turn supported on a forked end of a lever. This lever is journalled to the stationary structure of the machine and has an opposite end which abuts an intermediate part of an adjustment rod, journalled at one end to the stationary part of the machine and abuts at the other end thereof against a stationary part of the machine. The rod is displaceable out of its rest position by the action of levers which are driven by cams provided on the machine main drum.

Thus, the elevation of the needle cylinder can be adjusted as well as the stitch density as the main drum rotates progressively.

These devices have the disadvantage of being mechanically complicated in that several drive and lay levers are to be arranged.

Another disadvantage is that these machines are very laborious to tune-up and adjust, owing to the presence of many mechanical members, so that the operation requires much time if it is to provide reliable results. Furthermore, with multi-feed machines, where the machine is to operate at different densities between the feed, one must manipulate adjustment screws provided at each feed.

SUMMARY OF THE INVENTION

It is the primary aim of this invention to provide a circular knitting machine incorporating a stitch density adjuster device which affords a considerable simplification of the machine's mechanism, thus cutting down the machine tune-up time.

Within this aim, it is an object of this invention to provide a device which can be controlled electronically by an electronic machine control, such as a microprocessor, which follows the information of a program adapted to suit the user's own requirements.

Another object of the invention is to provide a device which allows automatically diversified adjustment of the stitch density at the various feed without requiring direct attendance by an operator.

The above aim and these and other objects to become apparent hereinafter are achieved by a circular knitting machine incorporating a stitch density adjuster device comprising a slide rigidly associated with a stitch cam and being movable relatively to the needle cylinder cam assemblies in a substantially parallel direction to the axis of said needle cylinder, characterized in that it comprises a step motor controlled by an electronic machine control and connected to a drive cam in rotary engagement with said slide to impose on said stitch cam a set adjusting displacement with respect to said needle cylinder cam assemblies, said slide being movable against and by the action of elastic means.

BRIEF DESCRIPTION OF THE DRAWINGS

Further features and advantages of the invention will be more clearly understood from the following description of a preferred, though not exclusive, embodiment of the inventive device, to be taken in conjunction with the accompanying illustrative and not limitative drawings, where.

DESCRIPTION OF THE PREFERRED EMBODIMENTS

Figure 1:
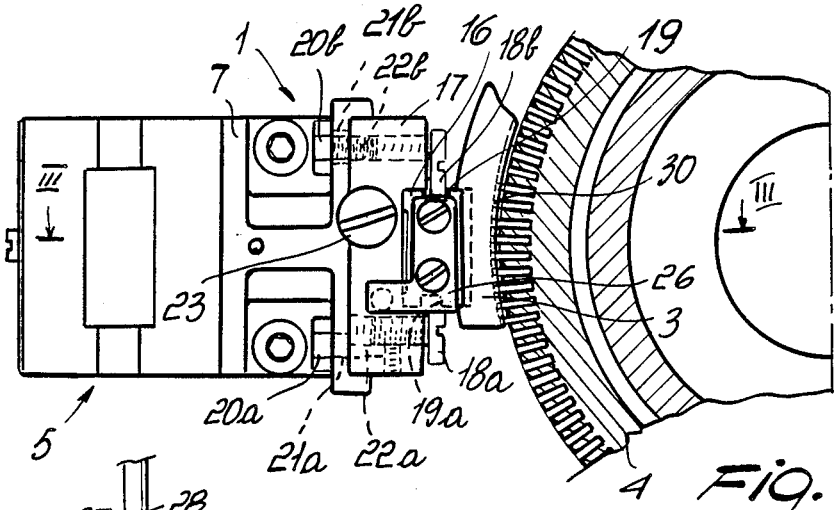
FIG. 1 is a top plan view of the device according to this invention as incorporated to a machine of which only a portion of the needle cylinder is shown, for clarity.
Figure 2:
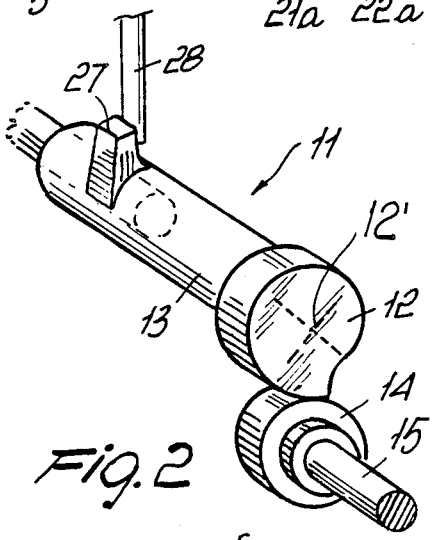
FIG. 2 is an enlarged perspective view showing drive cam of this invention.
Figure 3:
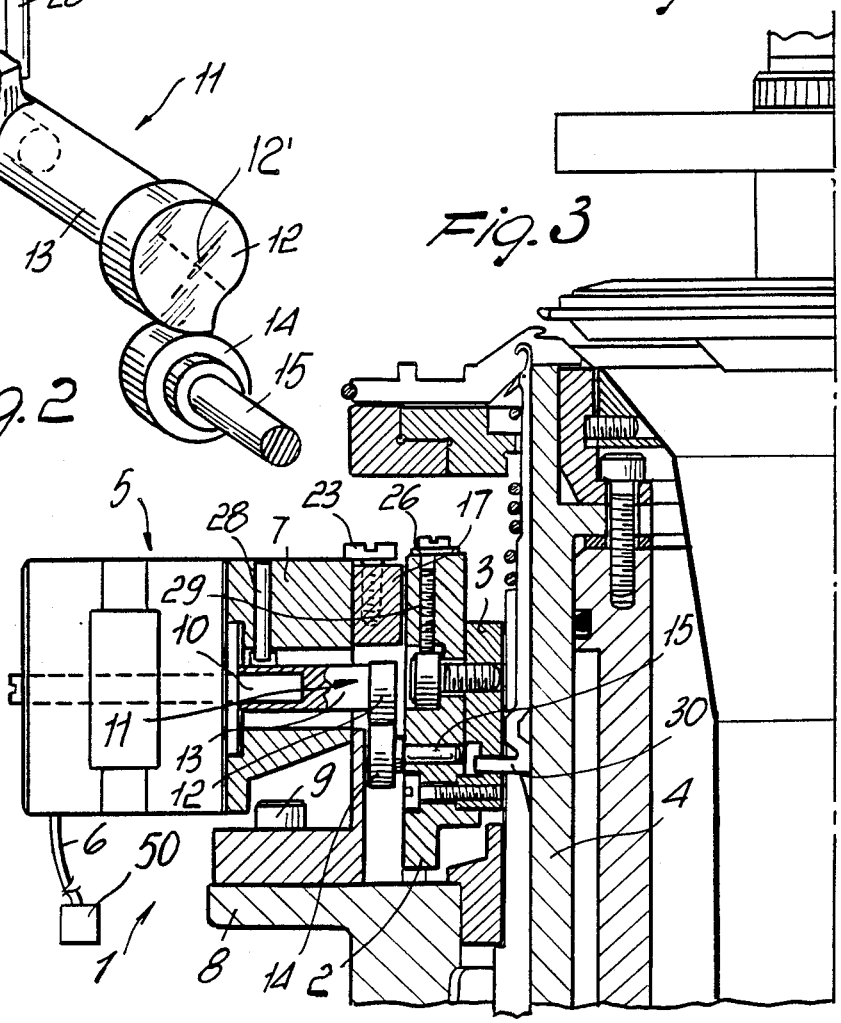
FIG. 3 is a sectional view of FIG. 1 taken along the line III—III as seen from one side.
Figure 4:
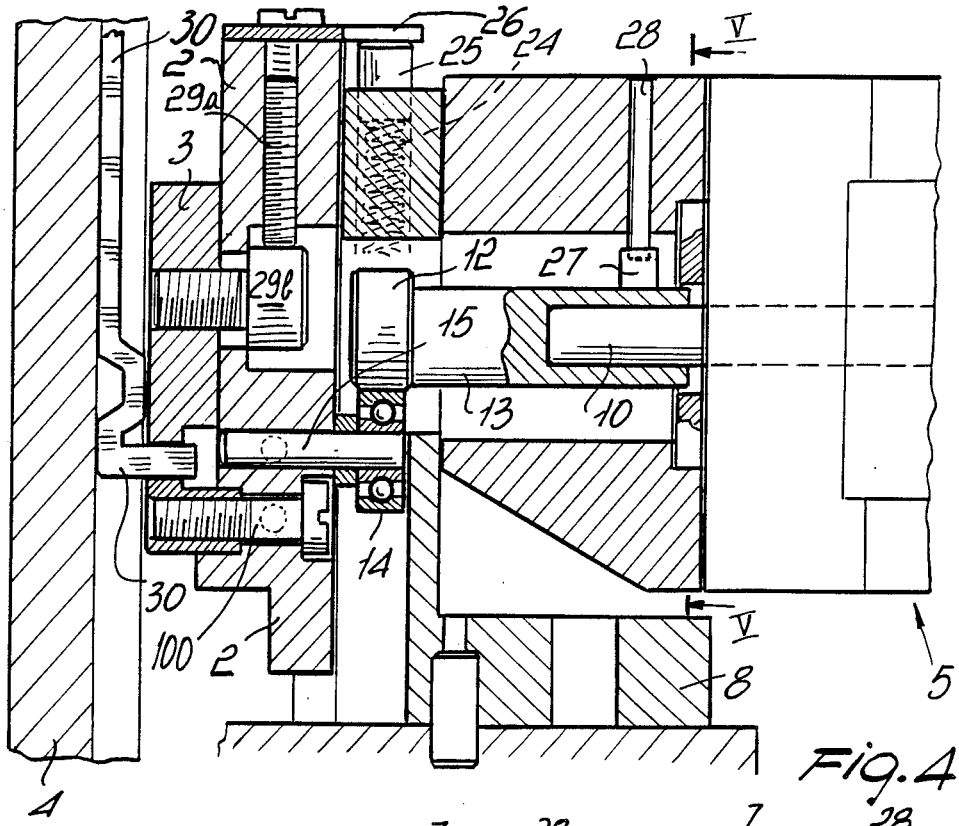
FIG. 4 is an enlarged sectional view of Figure 1 taken along the line III—III as seen from the other side.
Figure 5:
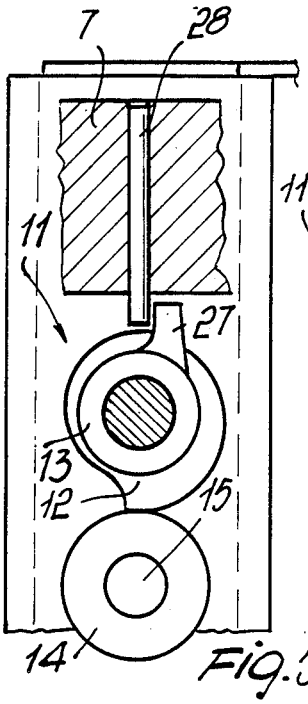
FIGS. 5, 6 and 7 are sectional views of part of FIG. 4 taken along the axis V—V and showing the drive cam at various operating positions.
Figure 6:
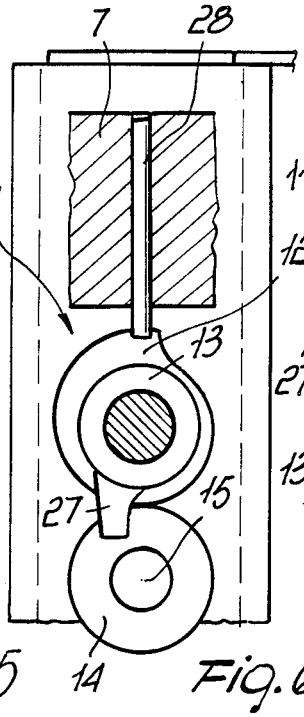
Figure 7:
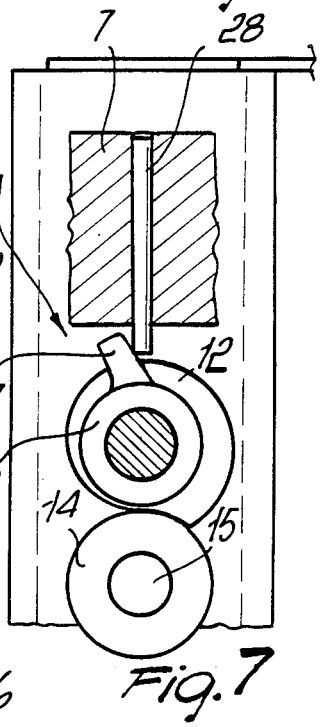

With reference to the drawing figures, a device according to the invention, as generally designated with the reference numeral 1, comprises a slide 2 rigidly associated with a stitch cam 3 by means of a screw 100 (FIG. 4) and being adjustably movable relatively to the cam assembly of the needle cylinder 4 in a substantially parallel direction to the needle cylinder axis. The device comprises, according to the invention, a step motor, generally designated with the reference numeral 5, actuated via its power lines 6 by an electronic machine control 50, such as a microprocessor following a set program.

The step motor is carried on a framework 7 rigidly associated with the machine load bearing structure 8, such as by screws 9, so as to make the axis of the output shaft 10 lay radially to the needle cylinder. The framework 7 is arranged in front of the stitch cam 3 radially ad distance therefrom with respect to the needle cylinder to leave an interspace therebetween. Rigidly associated with the output shaft is a drive cam 11 comprising essentially a cam having a center 12' and cam shaft 13 the axis of rotation of which being perpendicular to the needle cylinder axis and engaging rotatably i.e. transmissively with a cam follower 14, in turn secured to the slide 2. The cam follower 14 may also be a ball bearing so as to minimize the cam wear and retain a high degree of accuracy in the stitch density adjustment. The ball bearing is carried, in turn, on a small shaft 15 affixed to the slide 2 and in offset relationship to the cam-shaft 13. The slide 2, the cam 12, the camshaft 13 and the cam follower 14 constitute transmission means for transmitting adjusting motion from said step motor shaft 10 to said stitch cam 3. The slide 2 is movable within a groove or guideway 16 which extends, along a substantially parallel direction to the needle cylinder axis, inside a small adjustment block 17 and is held by a pair of screws **18*a* and 18*b* with their axes substantially perpendicular to the needle cylinder axis, which are rigidly associated with the adjustment block 17 and have their confronting head portions received slidably in a pair of grooves 19*a* and 19*b* carried on opposed sides of the slide. The adjustment block 17 may be shifted with respect to the framework 7 wherewith it is associated, e.g. by means of a pair of fastening screws 20*a* and 20*b* which engage in a pair of slots 21***a* and 21*b* extending in a substantially parallel direction to the needle cylinder and being carried on the framework 7, and by a pair of threaded holes 22*a* and 22*b* carried correspondingly on the adjustment block. To impart very small displacements to the adjustment block relatively to the framework 7 there is provided on the block 17 an adjustment screw 23 having its axis substantially parallel to needle cylinder axis and bearing with the bottom surface of its head on the top wall of the framework 7. The slide 2 according to the invention is, moreover, movable as mentioned against and by the action of an elastic means ensuring constant riding of the cam follower 14 on the cam profile 12. This elastic means may comprise, for example, a spring 24 housed in the adjustment block and engaging with a small plunger 25 carried on a plate 26 associated fixedly with the slide 2.

The cam 12 has a profile rising constantly from the rotation axis of the cam as the cam turns, thereby its pattern is that of a spiral section with radiused ends. The camshaft 13 has, aligned with the closest point on the cam 14 profile to the cam rotation axis, a detent dog 27 longitudinally at a distance from said cam 12, the detent dog, with the cam follower at its closest position to the rotation axis of the cam or zero position, abutting against a pin 28 carried correspondingly on the frame work 7. It will be understood from the foregoing that the detent dog 27 moves along a circular path when the cam-shaft 13 rotates and that the pin 28 extends into this path to provide a limit stop for resetting the rotation of the drive cam at the start of each knitting cycle.

This allows the forward movements of the drive cam to be reset automatically, in the sense that at the start of each knitting cycle the control 50 will control the step motor to perform a backward rotation equal to a complete revolution of the cam so as to reset all the previous positions, to then cause the detent dog to abut on the pin and possibly ending the rotational movement driven idly with respect to the cam. As clearly shown in the drawing the drive cam 12 has a center and a profile pattern substantially in the form of a spiral section, and the detent dog 27 is arranged on the drive cam shaft 13 at a point thereof in line with a point of said profile pattern radially nearest to the center of the drive cam 12. For completion of description, it should be said that for any adjustments of the stitch cam 3 relatively to the slide during the assembling stage, adjustment screws 29*a* and 29*b* (FIG. 4) may be provided to act between the slide 2 and the stitch cam 3. The device of this invention operates as follows. At the start of a knitting cycle, the electronic control 50 resets the rotation of the drive cam in the manner explained above and then, based on the directions from the knitting program, actuates the step motor to perform a preset rotation so as to produce, through the drive cam acting on the cam follower and hence on the slide, a displacement of the stitch cam relatively to the cam assemblies of the needle cylinder.

This results in a displacement of the needles 30 during the stitching step which provides for a greater or smaller length of the loops and the required stitch density. Depending on the step motor employed, or on the subdivision of the round angle, in conjunction with the profile pattern of the cam 12, the number of possible adjustments and extent of the change in stitch density are obtained. It has been found in practice that the inventive device fully achieves its aim by eliminating the requirement of control and lay lever systems and providing an increased range of adjustment of the stitch density. Another advantage of the device according to the invention is that the problem of the various mechanical parts wearing out is attenuated which required periodical adjustments to take up the resulting play. A further advantage is that one relies no longer on the machine main drum, which also controlled stitch density, thus achieving constructional simplification of the machine. A not least advantage is that a microprocessor is relied upon which may be connected to a device, such as an encoder, capable of controlling the various knitting steps while keeping control of the needle cylinder rotation at all times. Another advantage is that the machine tuning can be checked much faster. A further advantage is that of enabling automatic adjustment of the stitch density in an independent manner at the various feeds, thus achieving a high production rate even in the instance of some particular types of knitting. Of course, since the device is controlled electronically, it becomes possible to control a group of machines involved in like knittings by a single control. The machine with this device is susceptible to many modifications and variations without departing from the scope of this inventive concept; furthermore, all the details may be replaced with technical equivalents.

Of course, the device may be used on all knitting machines whenever, in order to change the stitch density, a preset displacement of the stitch cams is envisaged by providing one device according to the invention at each feed. For convenience of illustration, this invention has been described with reference to a device mounted on the needle cylinder, it being understood that the device may alternatively be mounted on the dial of a knitting machine with dial and cylinder; in this case, the displacement of the stitch cams would take place in a radial direction to the dial. In practicing the invention, the materials used and the dimensions may be any ones contingent on requirements and the state of the art.

I claim:

1. In a circular knitting machine including a supporting structure, a needle cylinder having an axis of rotation, cam assemblies near said needle cylinder, said needle cylinder rotating about said axis of rotation thereof and relative to said cam assemblies, said cam assemblies including stitch cam means adjustably movable in a direction substantially parallel to the axis of rotation of said needle cylinder, a stitch density adjusting device comprising a framework arranged in front of said stitch cam means at a radial distance therefrom with respect to said needle cylinder to leave an interspace therebetween, said framework being supported by said supporting structure, supported on said framework a step motor having a shaft, within said interspace transmission means transmitting adjusting motion from said step motor shaft to said stitch cam means to impart to said stitch cam means a preset displacement relative to said cam assemblies and an electronic machine control connected with said step motor for controlling the operation thereof, said transmission means comprising drive cam means connected to said step motor shaft, cam follower means in transmissive engagement with said drive cam means, a slide arranged near said stitch cam means, connection means for connecting said slide with said stitch cam means, guide means for guiding said slide in a direction parallel to the axis of rotation of said needle cylinder, said cam follower means being secured to said slide to transmit to said slide the motion received from said drive cam means, wherein said drive cam means comprise a cam shaft extending perpendicular to said needle cylinder axis of rotation and having a detent dog fixed thereon, said detent dog defining a circular path thereof following rotation of said cam shaft, and wherein said framework comprises a pin formation secured thereon and extending into said circular path of said detent dog to determine a limit stop for resetting the rotation of said drive cam at the start of each knitting cycle.

2. A device according to claim 1, wherein said cam follower means comprise a shaft fixed on said slide and projecting with a free end thereof from said slide and a ball bearing on said shaft free end, said ball bearing being arranged to transmissively engage said drive cam means.

3. A device according to claim 1, wherein said drive cam means comprise a drive cam having a center and a profile pattern substantially in the form of a spiral section and wherein said detent dog is arranged on said drive cam shaft at a point thereof in line with a point of said profile pattern radially nearest to the center of said drive cam.

4. In a circular knitting machine including a supporting structure, a needle cylinder having an axis of rotation, cam assemblies near said needle cylinder, said needle cylinder rotating about said axis of rotation thereof and relative to said cam assemblies, said cam assemblies including stitch cam means adjustably movable in a direction substantially parallel to the axis of rotation of said needle cylinder, a stitch density adjusting device comprising a framework arranged in front of said stitch cam means at a radial distance therefrom with respect to said needle cylinder to leave an interspace therebetween, said framework being supported by said supporting structure, supported on said framework a step motor having a shaft extending radially to said needle cylinder, within said interspace transmission means transmitting adjusting motion from said step motor shaft to said stitch cam means to impart to said stitch cam means a preset displacement relative to said cam assemblies and an electronic machine control connected with said step motor for controlling the operation thereof, said transmission means comprising, a drive cam shaft connected to and in alignment with said step motor shaft and a drive cam on said drive cam shaft, cam follower means having a cam follower shaft extending parallel to said drive cam shaft in offset relationship thereto and a cam follower formation on said cam follower shaft in transmissive engagement with said drive cam, a slide arranged between said stitch cam means and said drive cam, connection means for connecting said slide with said stitch cam means, a guideways defining adjustment block between said framework and said slide and adjustably secured onto said framework for guiding said slide in a direction parallel to the axis of rotation of said needle cylinder, said cam follower shaft being secured to and projecting from said slide at a side thereof opposite to said stitch cam means to transmissively engage said drive cam means to transmit thereby to said slide the displacement motion received from said drive cam, spring means urging said slide to maintain constant transmissive engagement between said drive cam and said cam follower, wherein said drive cam shaft has a detent dog fixed thereon longitudinally at a distance from said drive cam, said detent dog defining a circular path thereof following rotation of said cam shaft, and wherein said framework comprises a pin formation secured thereon and extending into said circular path of said detent dog to determine a limit stop for resetting the rotation of said drive cam at the start of each knitting cycle, wherein said drive cam has a center and a profile pattern substantially in the form of a spiral section and wherein said detent dog is arranged on said drive cam shaft at a point thereof longitudinally at a distance from and in line with a point of said profile pattern radially nearest to the center of said drive cam.

5. A device according to claim 4, wherein said connection means for connecting said slide with said stitch cam means include an adjustment screw acting between said slide and said stitch cam means to adjust the relative position of said slide with respect to said stitch cam means.

* * * * *